US009743706B2

(12) United States Patent
Friedl

(10) Patent No.: US 9,743,706 B2
(45) Date of Patent: Aug. 29, 2017

(54) HALLUX ALPINE BOOT

(71) Applicant: Fenix Outdoor AB, Örnsköldsvik (SE)

(72) Inventor: Johann Friedl, St. Roman (AT)

( * ) Notice: Subject to any disclaimer, the term of this patent is extended or adjusted under 35 U.S.C. 154(b) by 0 days.

(21) Appl. No.: 14/609,061

(22) Filed: Jan. 29, 2015

(65) Prior Publication Data

US 2015/0216260 A1 Aug. 6, 2015

(30) Foreign Application Priority Data

Jan. 31, 2014 (DE) ..... 10 2014 101 191

(51) Int. Cl.

| | |
|---|---|
| ***A43B 5/00*** | (2006.01) |
| ***A43B 7/12*** | (2006.01) |
| ***A43B 19/00*** | (2006.01) |
| ***A43B 23/07*** | (2006.01) |

(52) U.S. Cl.

CPC ..... *A43B 5/002* (2013.01); *A43B 7/125* (2013.01); *A43B 19/00* (2013.01); *A43B 23/07* (2013.01)

(58) Field of Classification Search

CPC ..... A43B 23/07; A43B 23/022; A43B 19/00; A43B 7/24; A43B 7/28; A43B 5/002; A43B 5/0405; A43B 5/0482; A43B 5/1616; A43B 5/1625

USPC ..... 36/114, 43, 55, 88

See application file for complete search history.

(56) References Cited

U.S. PATENT DOCUMENTS

| | | | | | |
|---|---|---|---|---|---|
| 579,397 | A * | 3/1897 | King | A43B 7/125 | 36/14 |
| 2,578,987 | A * | 12/1951 | Schultz | A43B 7/32 | 36/55 |
| 2,827,713 | A * | 3/1958 | Maccarone | A43C 11/002 | 36/55 |
| 5,099,588 | A * | 3/1992 | Scholl | A43B 23/07 | 36/55 |
| 5,678,833 | A * | 10/1997 | Olson | A43B 3/26 | 280/11.224 |
| 5,839,735 | A * | 11/1998 | Benoit | A43B 5/1675 | 280/11.202 |
| 6,446,360 | B1 * | 9/2002 | Sheets | A43B 23/07 | 12/142 T |
| 7,707,747 | B2 * | 5/2010 | Nawachi | A43B 7/26 | 36/55 |
| 2002/0088145 | A1 * | 7/2002 | Clark | A43B 3/26 | 36/97 |
| 2004/0205982 | A1 * | 10/2004 | Challe | A43B 9/02 | 36/55 |
| 2004/0216332 | A1 * | 11/2004 | Wilson | A43B 7/08 | 36/55 |

(Continued)

FOREIGN PATENT DOCUMENTS

CN 202311393 7/2012

*Primary Examiner* — Shaun R Hurley
*Assistant Examiner* — Bao-Thieu L Nguyen
(74) *Attorney, Agent, or Firm* — Jeffer Mangels; Butler & Mitchell LLP; Brennan C. Swain, Esq.

(57) ABSTRACT

The present invention relates to an outdoor shoe, in particular a climbing or hiking shoe, with an inside lining and an upper material. The invention is characterized in that the inside lining has a first material and a second material, wherein the second material is arranged at least in the area of a hallux basal joint position and wherein the second material has a greater extensibility than the first material.

20 Claims, 4 Drawing Sheets

(56) References Cited

U.S. PATENT DOCUMENTS

| | | | | |
|---|---|---|---|---|
| 2005/0102862 | A1* | 5/2005 | Baychar | A41D 27/02 36/55 |
| 2005/0241189 | A1* | 11/2005 | Elkington | A43B 3/0047 36/117.6 |
| 2006/0112599 | A1* | 6/2006 | Braynock | A43B 1/0036 36/137 |
| 2007/0011913 | A1* | 1/2007 | Holzer | A43B 5/0411 36/50.1 |
| 2007/0107257 | A1* | 5/2007 | Laska | A43B 1/0027 36/4 |
| 2007/0227038 | A1* | 10/2007 | Edington | A43B 19/00 36/10 |
| 2008/0086914 | A1* | 4/2008 | Curry | A43B 1/0081 36/101 |
| 2009/0307930 | A1* | 12/2009 | Perizzolo | A43B 5/0405 36/115 |
| 2013/0111784 | A1* | 5/2013 | Kann | A43B 1/0081 36/72 R |
| 2013/0174443 | A1* | 7/2013 | Mankowski | A43B 19/00 36/10 |
| 2014/0059894 | A1* | 3/2014 | Lupinek | A43B 7/34 36/137 |
| 2014/0090274 | A1* | 4/2014 | Arquilla | A43B 1/0045 36/83 |
| 2014/0352178 | A1* | 12/2014 | Bruce | A43B 17/08 36/3 A |
| 2015/0150335 | A1* | 6/2015 | Healy | A43B 7/12 36/87 |

* cited by examiner

HALLUX ALPINE BOOT

FIELD OF THE INVENTION

The present invention relates to an outdoor shoe, in particular a climbing or hiking shoe having an inside lining and an upper material.

BACKGROUND OF THE INVENTION

Outdoor shoes can be used in alpine sports, in polar expeditions or desert expeditions, in hiking and also in intensified walking.

More and more people get enthusiastic about activities of movement out in the open and, in particular hiking in the mountains. In order to here get forward sure-footed and protected from injuries the suitable footwear is indispensable. Correspondingly, there is a number of outdoor shoes, such as for example hiking shoes extending above the ankle, low shoes having a rustic profile, water-proofed shoes, light and well ventilated footwear and also special footwear for expeditions to the polar regions, to only mention a few examples.

However, a general problem is that the foot of a human being is not like that of another human being and, above all there are humans having foot deformations. Humans having such foot deformations can or should not readily use conventional footwear. For these groups of people the adaption of standard outdoor shoes is possible in certain limits, for example by using insoles or by other orthopedic measures. However, depending on the type and difficulty of the foot deformation it could be necessary to entirely switch to completely made-up footwear or even use special orthopedic shoes. However, such footwear is very expensive to purchase and optionally not suited for the intended use as outdoor shoe, since the profiling is insufficient, for example.

Furthermore, individual foot deformations can also change over time—in particular deteriorate—which requires a new adaption or even a new acquisition of the footwear.

In this context, above all the foot deformation known as intoe or oblique toe is problematic. In this disease there is a misalignment of the hallux that in the hallux basal joint swerves to the outside towards the lateral border of the foot. This is caused by a movement of the metatarsal towards the medial border of the foot. Said misalignment over time can increase to such an extent that normal outdoor shoes cannot and should not be worn from a certain point of time, since the foot is strongly broadened in the area of the hallux basal joint. Sometimes, the wrong footwear is responsible for the development or deterioration of an intoe.

Against this background, it is the object of the present invention to provide an outdoor shoe that can be worn by people having a foot deformation, in particular an intoe, without the shoe must specifically being made-up for the wearer.

SUMMARY OF THE PREFERRED EMBODIMENTS

The solution of the problem is accomplished with the features of Claim 1. Advantageous further developments are described in the dependent claims.

The outdoor shoe according to the invention is in particular characterized in that the inside lining has a first material and a second material, with the second material being at least arranged in the area of a hallux basal joint position and the second material having a greater extensibility than the first material. In other words, with respect to a shoe in use at least in the area in which the hallux swerves to the outside towards the lateral border of the foot or the metatarsal swerves towards the medial border of the foot there is provided a second material that differs in extensibility from the first material intended for the remaining inside lining at least in the area of the toes. Thus, by the second material an extension of the inside lining away from the hallux basal joint can be permitted, toward the upper material.

If the wearer has an intoe, so the metatarsal or phalanx, respectively in the area of the hallux basal joint position will be able to extend the second material, so that a very good comfort is achieved without there being a disturbing pressure in the area of the hallux basal joint. Furthermore, depending on the intensity of the intoe the extension of the second material can more or less be possible. Therefore, the outdoor shoe according to the invention is suitable for many people having an intoe that is differently pronounced and, also when the intoe deteriorates over time, can still be used by the same wearer, since the second material compensates for the stronger lateral swerve of the hallux. Accordingly, the shoe can also be further used in case of an improvement of the clinical picture, for example after a surgical correction.

Furthermore, it is of advantage if the extensibility of the second material is at least 50% above the extensibility of the first material. Thus, sufficient stability of the inside lining is ensured and at the same compensated for a strong lateral swerve of the hallux.

It is suitable, if the upper material in the area of the hallux basal joint position is free from a seam. The lateral swerve of the second material due to the intoe of the wearer must not be affected by the upper material. Since in particular leather is used with outdoor shoes the upper material can follow the movement of the second material, wherein also other materials besides leather can have the appropriate properties. However, a seam would strongly limit the movability, so that it is advantageous not to provide a seam in the area of the upper material in which the extension of the second material by the intoe occurs. Moreover, it is conceivable to create additional space in the area of the hallux basal joint position in which the lateral extension can take place to an enlarged extent by shaping out the upper material of the outdoor shoe, for example in the form of a bulge.

It is advantageous, if the first material and/or the second material is a water-tight and vapor-diffusion open membrane. Thus, it can be ensured that the outdoor shoe can also be used in the rain or snow, without water penetrating the outdoor shoe, but at the same time a ventilation of the outdoor shoe is possible.

In a further development the second material has a lower frictional resistance than the first material. This has the advantage that the outdoor shoe can easier be put on by people having an intoe without pain occurring when dressing. Furthermore, even when walking this results in a reduced risk for chafe sites or blistering, since just the second material according to the invention at least partially directly clings to the foot or a sock, respectively.

It is advantageous, if the first material and/or the second material is moveable regarding to the upper material. In other words, it is in particular of advantage, if the first material and/or the second material is not adhered or sewn to the upper material. This way, the first and/or second material can move regarding to the upper material and thus, an optimum compensation of the lateral swerve of the hallux of a wearer of the outdoor shoe with an intoe can be achieved.

Advantageously, the first material is sewn to the second material. Sewing up permits a permanent and robust connection between the first material and the second material, since said connection in particular in case of a pronounced intoe is particularly strained.

Of course, the inside lining can also be made up of more than two materials, for example in the area of the leg or the tongue.

In the following, the invention is explained in detail with respect to an example shown in the drawings.

DETAILED DESCRIPTION OF THE PREFERRED EMBODIMENTS

Figure 1:
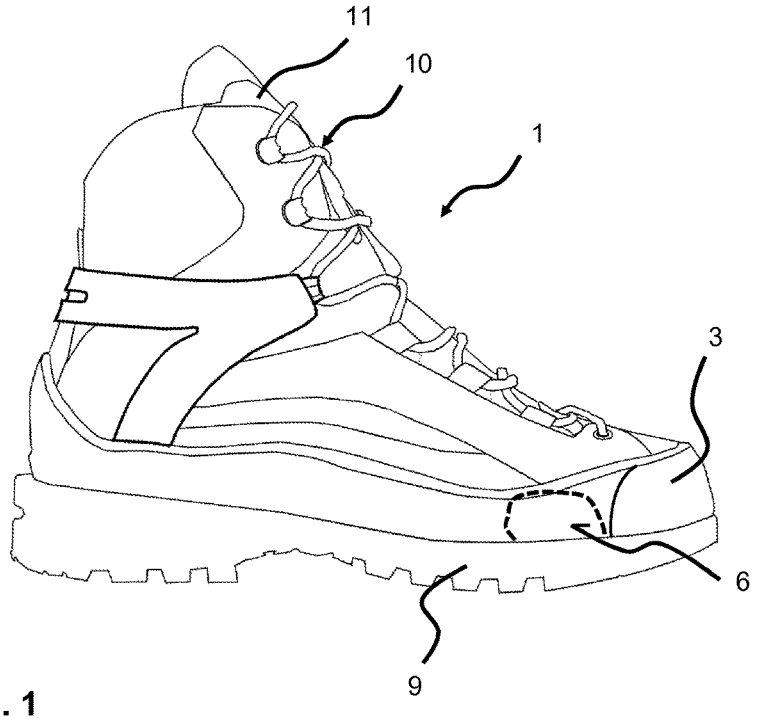
FIG. 1 shows schematically a side view of an outdoor shoe according to the invention.
Figure 2:
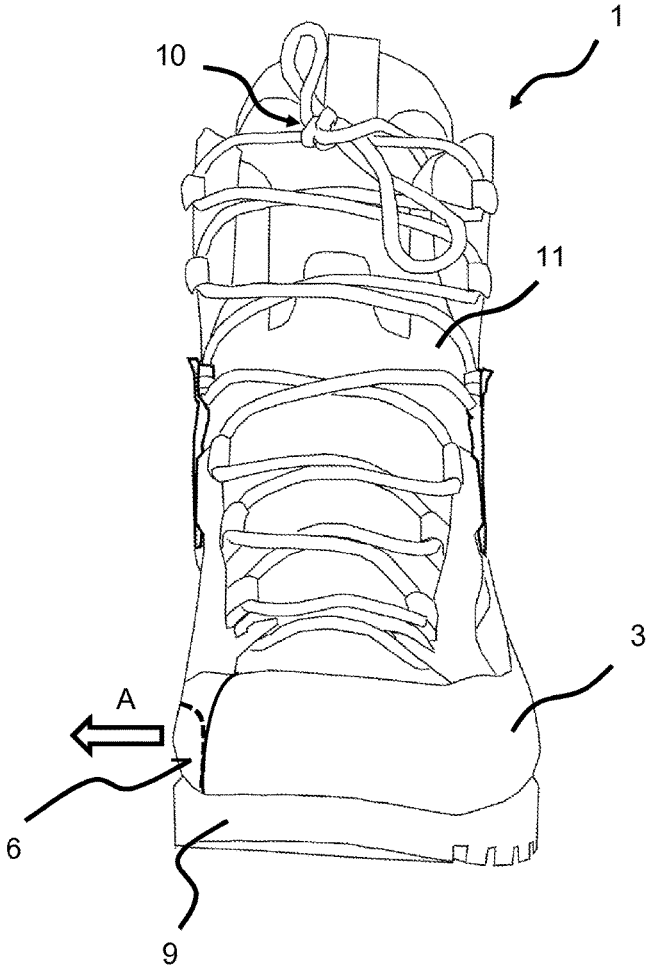
FIG. 2 shows schematically a front view of the outdoor shoe shown in FIG. 1.
Figure 3:
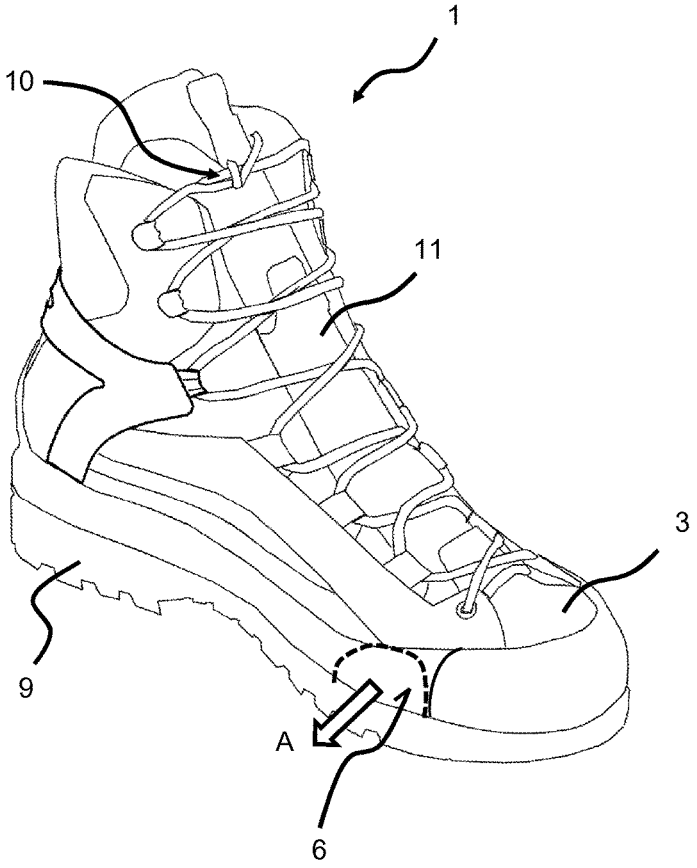
FIG. 3 shows schematically a perspective view of the outdoor shoe shown in FIG. 1.

In FIG. 1 to FIG. 3 there is illustrated an outdoor shoe 1 according to the invention in the form of a climbing or hiking shoe extending above the ankle. The outdoor shoe 1 has an upper material 3 made of leather that is connected to the sole 9 of the outdoor shoe 1. In this example, the upper material 3 is adhered to the sole 9. Further, the outdoor shoe 1 has a lacing 10 as well as a tongue 11 with which the outdoor shoe 1 can tightly be attached to the foot of the wearer (not illustrated).

If the wearer puts on the outdoor shoe 1, so the hallux basal joint is in the area 6 that is illustrated by the broken line in FIG. 1 to FIG. 3. In this area referred to as hallux basal joint position 6 in case of a wearer having an intoe there is also the broadening of the foot generated by the lateral swerve of the hallux or the metatarsal, respectively. This broadening or lateral swerve of the foot is compensated by the present invention, as is explained below.

Figure 4:
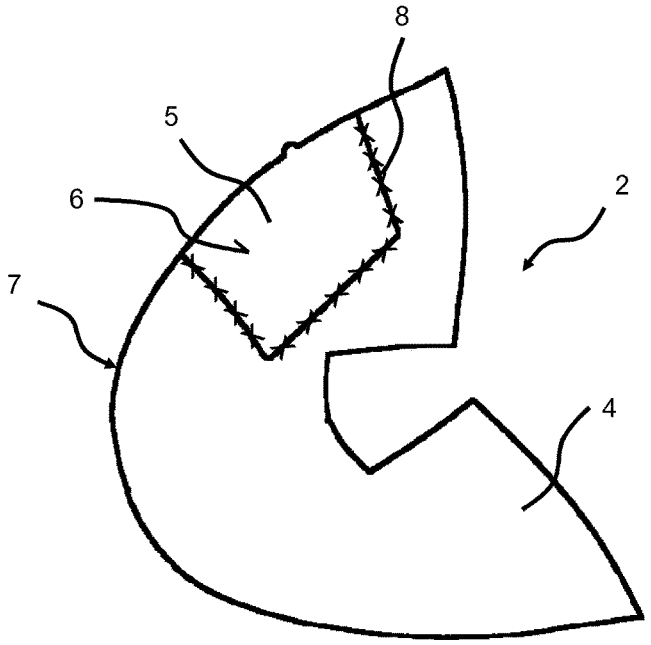
FIG. 4 shows schematically a section of an inside lining of an outdoor shoe according to the invention.

For that, the inside lining 2 of the outdoor shoe 1 according to the invention is made up of at least two materials 4, 5 that differ in their extensibility. A section of the inside lining 2 is illustrated in FIG. 4. The section illustrated in FIG. 4 relates to the toecap 7 of the inside lining 2 of the outdoor shoe 1 according to the invention. The inside lining 2 of the toecap 7 is made up of a first material 4 and a second material 5 with the first material 4 being connected to the second material 5 along the seam 8. As shown in FIG. 4, the second material can have a quadrangle shape. As is also shown in FIG. 4, the toecap portion includes an upper portion, a medial portion and a lateral portion and the second section is only located in the medial portion.

The second material 5 in this example is provided as a substantially quadrangular formed piece of material in the area of the hallux basal joint position 6. According to the invention the second material 5 has a higher extensibility than the remaining toecap 7 of the inside lining 2 made up of the first material 4. In this example, the extensibility of the second material 5 can be at least 50% above the extensibility of the first material 4.

If the wearer having the intoe puts on the outdoor shoe 1, then his misaligned hallux basal joint is in the area of the second material 5 of the inside lining 2 of the outdoor shoe 1. The second material 5 can follow the misalignment of the hallux basal joint and permits its compensation by extending the second material 5 towards the upper material 3 of the outdoor shoe 1, as illustrated by the arrow A in FIG. 2 and FIG. 3. Since the upper material 3 in this area is free from a seam—in the illustrated example the seam extends above the hallux basal joint position 6—the upper material 3 can follow the extension and co-compensate the misalignment caused by the intoe of the wearer. Since the first material 4 is significantly stiffer than the second material 5 no extensive extension of the inside lining 2 occurs, but there is only an extension in the area of the second material 5, that is in the area of the hallux basal joint position 6.

The invention claimed is:

1. An outdoor shoe for alleviating discomfort caused by an intoe condition with an inside lining and an upper material that defines an upper material interior, wherein the inside lining has an inner surface, characterized in that a toecap section of the inside lining related to a toecap of the outdoor shoe is made of a first material and a second material that each have an inner surface that is part of the inner surface of the inside lining, wherein the second material is adapted to be arranged in the area of a hallux basal joint position when the outdoor shoe is worn by a user, wherein the second material has a greater flexibility than the first material, wherein the portion of the upper material that is positioned immediately outwardly adjacent the second material of the inside lining comprises leather.

2. The outdoor shoe according to claim 1, characterized in that the upper material outwardly adjacent to the second material is free from a seam.

3. The outdoor shoe according to claim 1, characterized in that the first material is a water-tight and vapor-diffusion open membrane.

4. The outdoor shoe according to claim 1, characterized in that the second material is a water-tight and vapor-diffusion open membrane.

5. The outdoor shoe according to claim 1, characterized in that the second material has a lower frictional resistance than the first material.

6. The outdoor shoe according to claim 1, characterized in that the second material is movable with respect to the upper material.

7. The outdoor shoe according to claim 1, characterized in that the first material is movable with respect to the upper material.

8. The outdoor shoe according to claim 1, characterized in that the first material is sewn to the second material.

9. The outdoor shoe according to claim 2, characterized in that the first material is a water-tight and vapor-diffusion open membrane.

10. The outdoor shoe according to claim 9, characterized in that the second material is a water-tight and vapor-diffusion open membrane.

11. The outdoor shoe according to claim 10, characterized in that the second material has a lower frictional resistance than the first material.

12. The outdoor shoe according to claim 11, characterized in that the second material is movable with respect to the upper material.

13. The outdoor shoe according to claim 12, characterized in that the first material is movable with respect to the upper material.

14. The outdoor shoe according to claim 13, characterized in that the first material is sewn to the second material.

15. The outdoor shoe of claim 14 wherein the second material has a quadrangle shape.

16. An outdoor shoe for alleviating discomfort caused by an intoe condition comprising:

a sole, an upper connected to the sole, wherein the upper includes an inside surface, and wherein the upper and the sole cooperate to define a shoe interior, an inside lining positioned adjacent the inside surface of the upper, wherein the inside lining has an inside surface, wherein the inside lining defines a toecap portion that includes a first section made of a first material and a second section made of a second material, wherein the first section is connected to the second section along a seam, wherein the first section and the second section each have an inner surface that is part of the inner surface of the inside lining, wherein the second section is adapted to be positioned adjacent a hallux basal joint when a user wears the outdoor shoe, and wherein the second material is more flexible than the first material.

17. The outdoor shoe of claim 16 wherein the second material is at least 50% more flexible than the first material.

18. The outdoor shoe of claim 17 wherein the toecap portion includes an upper portion, a medial portion and a lateral portion, wherein the second section is only located in the medial portion.

19. The outdoor shoe of claim 18 wherein the portion of the upper that is positioned immediately outwardly adjacent the second section of the inside lining comprises leather.

20. The outdoor shoe of claim 19 wherein the second section has a quadrangle shape.

* * * * *